US005090784A

United States Patent [19]

Battista

[11] Patent Number: 5,090,784

[45] Date of Patent: Feb. 25, 1992

[54] CONCEALED JEWELRY CASE

[76] Inventor: Anthony Battista, 6089 NW. 74th Ter., Parkland, Fla. 33067

[21] Appl. No.: 426,792

[22] Filed: Oct. 25, 1989

[51] Int. Cl.[5] ..... A47B 17/04

[52] U.S. Cl. ..... 312/204; 312/227

[58] Field of Search ..... 312/204, 227, 245, 326, 312/329

[56] References Cited

U.S. PATENT DOCUMENTS

| | | | |
|---|---|---|---|
| 164,087 | 6/1875 | Horsfall | 312/227 |
| 787,243 | 4/1905 | Warren | 312/227 X |
| 1,006,481 | 10/1911 | Johnson et al. | 312/227 |
| 1,557,959 | 10/1925 | Anderson | 312/227 |
| 1,776,464 | 9/1930 | Blackman | 312/227 |
| 3,997,219 | 12/1976 | Phelps | 312/245 |
| 4,304,447 | 12/1981 | Ettwood et al. | 312/204 |
| 4,324,446 | 4/1982 | LeSage | 312/245 |
| 4,573,585 | 3/1986 | Frei | 211/13 |
| 4,776,650 | 10/1988 | Ferenzi | 312/245 |
| 4,854,656 | 8/1989 | O'Keefe | 211/13 |

*Primary Examiner*—Joseph Falk

*Attorney, Agent, or Firm*—Malin, Haley, McHale, DiMaggio & Crosby

[57] ABSTRACT

A combination dresser and concealed jewelry case comprised of an ordinary-looking dresser/mirror assembly combination wherein the front mirror panel of said mirror is hingedly connected to the mirror assembly. Swinging open said mirror panel reveals a jewelry cabinet of relatively shallow depth therewith. Means for locking said mirror panel in the closed position is provided. The concealed jewelry case and mirror are shallow in depth so as to appear merely as a sturdy mirror support and not to appear to be a concealed jewelry case.

2 Claims, 2 Drawing Sheets

FIG. 4
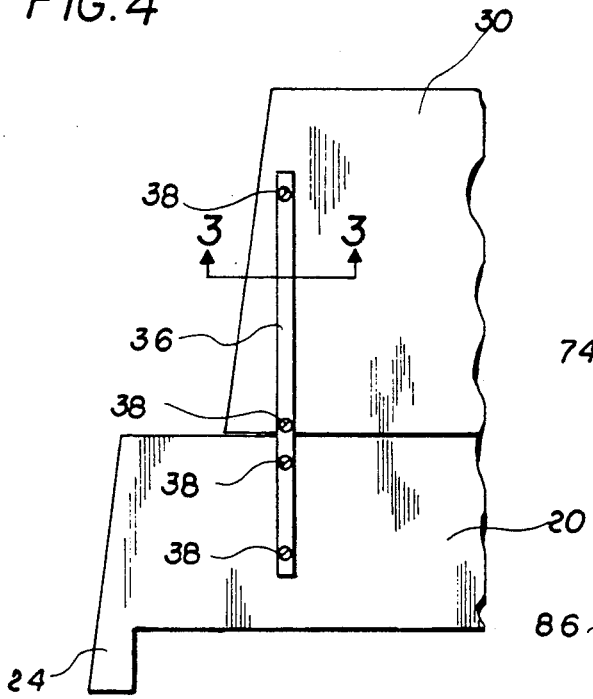
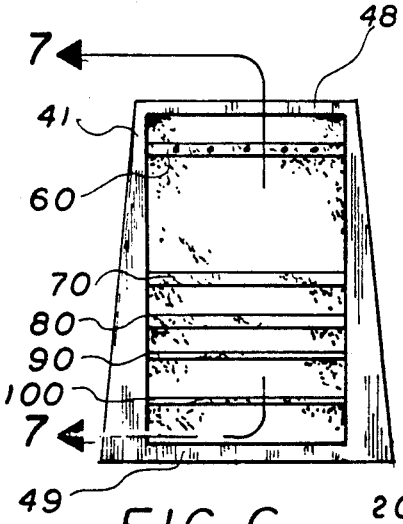
FIG. 6
FIG. 5
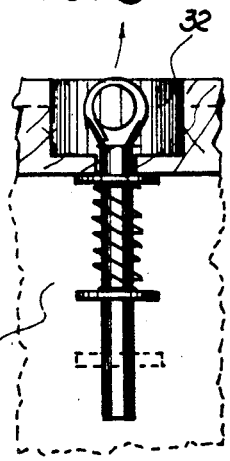
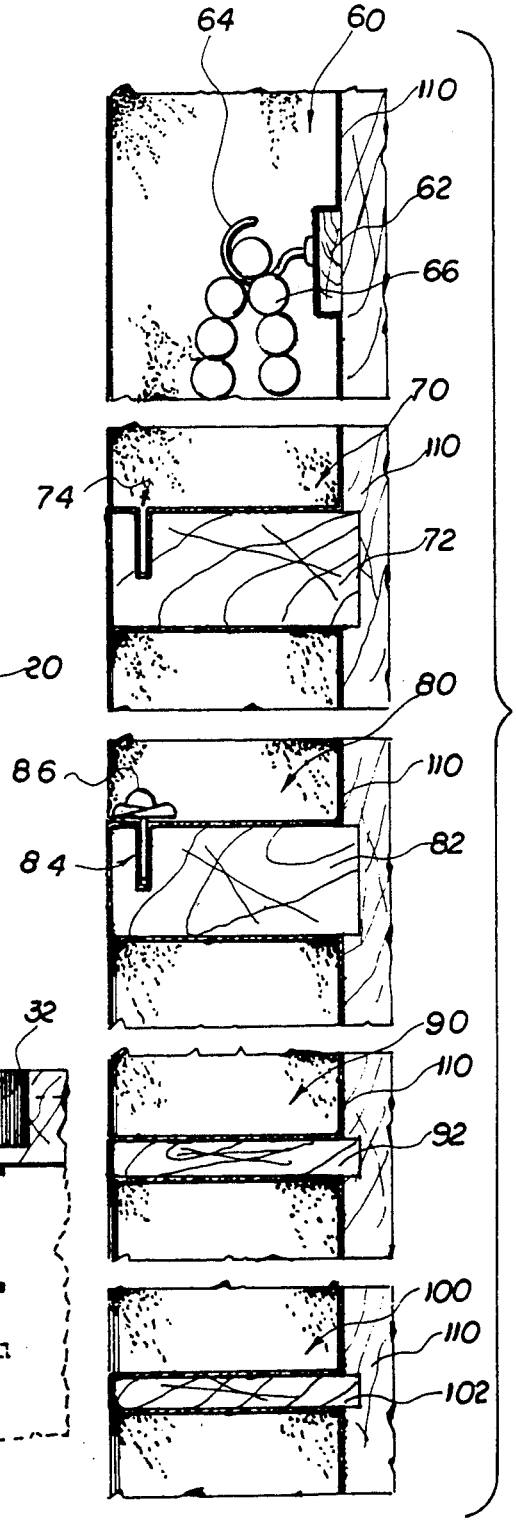
FIG. 7

CONCEALED JEWELRY CASE

BACKGROUND OF THE INVENTION

1. Field of the Invention

This invention relates to jewelry boxes and in particular to a combination dresser, mirror, and concealed jewelry case.

2. Description of Prior Art

Most jewelry cases look like devices to store jewelry. As a consequence, they are readily identifiable. In particular, when a home is burglarized, a burglar typically has no difficulty in identifying the jewelry case. Once the jewelry case is identified, the burglar can then take any jewelry found therein, much to the dismay of the owner.

Devices have been made which combine dressers, mirrors, and wardrobe cabinets to utilize the space behind a dresser mirror. Examples of such devices are:

U.S. Pat. No. 1,557,959 ANDERSON

U.S. Pat. No. 787,243 WARREN

U.S. Pat. No. 164,087 HORSFALL

While these devices show concealed wardrobes comprising a substantial depth dimension, they do not show a concealed compartment behind a dresser mirror that is thin in depth so as to give the visual impression that there is no compartment behind the mirror. And, in particular, these devices do not show a concealed jewelry case behind the mirror.

SUMMARY OF THE INVENTION

It is therefore useful to provide a jewelry case that is not readily identifiable as a jewelry case. In view of this, it is useful to provide a jewelry case concealed in a piece of ordinary looking furniture such as a dresser and a mirror.

The instant invention is a combination dresser, mirror, and concealed jewelry case. The concealed jewelry case is associated with the top surface of a dresser and is concealed by a pivoting mirror which opens to reveal the concealed jewelry case. The pivoting means about which the mirror rotates to open is hidden behind the mirror so as not to be visible from the front of the invention. The concealed jewelry case is shallow in depth so that the combination concealed jewelry case and mirror visually appear to be merely a sturdy mirror support and not a concealed jewelry case.

It is an object of the invention to provide a jewelry case that is not readily identifiable as a jewelry case.

It is another object of the invention to provide a jewelry case that is concealed in a piece of ordinary looking furniture.

It is another object of the invention to provide a jewelry case concealed behind a mirror of an ordinary looking dresser and mirror combination.

In accordance with these and other objects which will be apparent to those skilled in the art, the invention will now be described with particular reference to the accompanying drawings.

BRIEF DESCRIPTION OF THE DRAWINGS

In the drawings:

FIG. 4 is a rear partial view of the dresser and mirror combination.

FIG. 5 is a sectional view of a means for locking the jewelry case in the closed position.

FIG. 6 is a front view of the concealed jewelry case with the mirror removed to show an interior configuration of the jewelry case.

FIG. 7 is a partial side cutaway view of the interior of the concealed jewelry case taken along line 7—7 of FIG. 6.

DETAILED DESCRIPTION OF THE INVENTION

Figure 1:
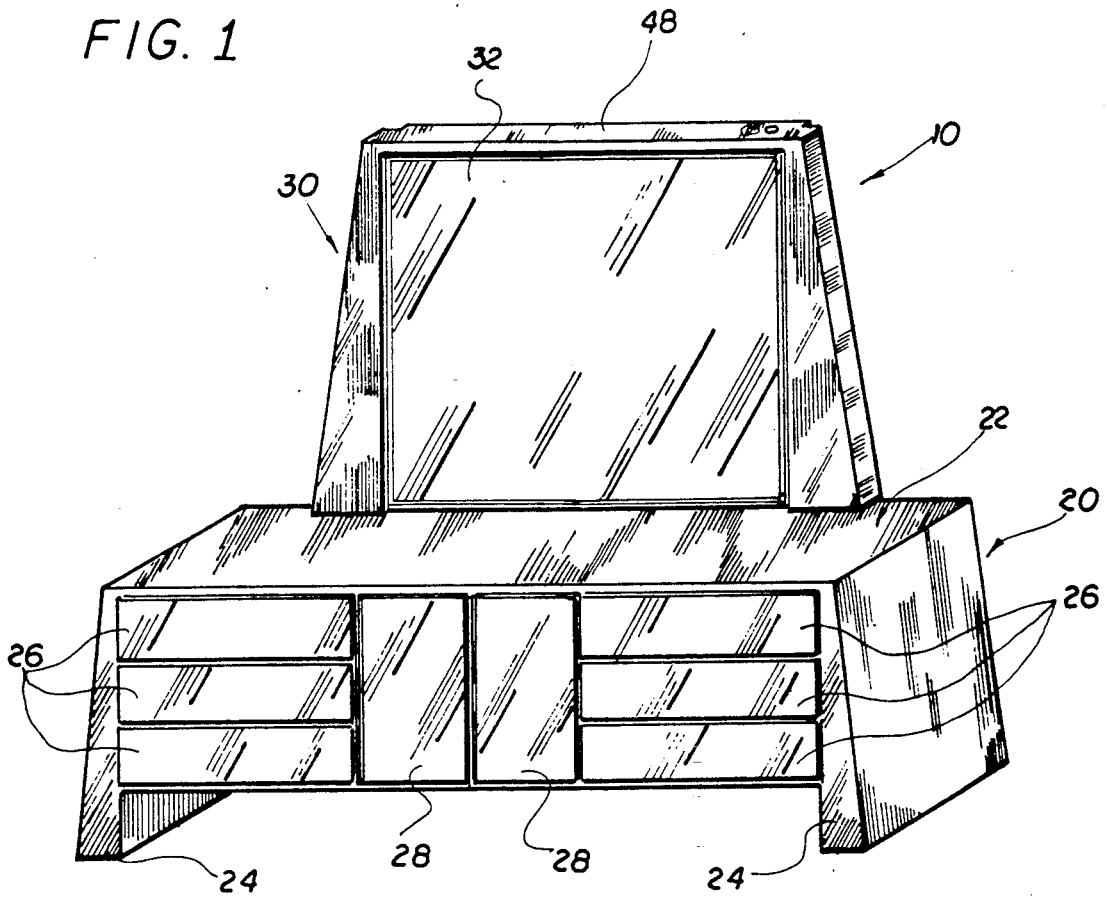
FIG. 1 is a front perspective view of the invention.

In FIG. 1 is shown the invention generally designated by the reference numeral 10. There is shown a dresser 20 with a top surface 22 which acts as a support for mirror/jewelry case assembly 30. Legs 24 may be employed to support the dresser a small distance above the floor, or the dresser cabinet may rest on the floor as desired. Arranged in the dresser 20 are several drawers 26 which slide in and out of the dresser 20. Swinging doors 28 may be utilized in conventional fashion.

Figure 2:
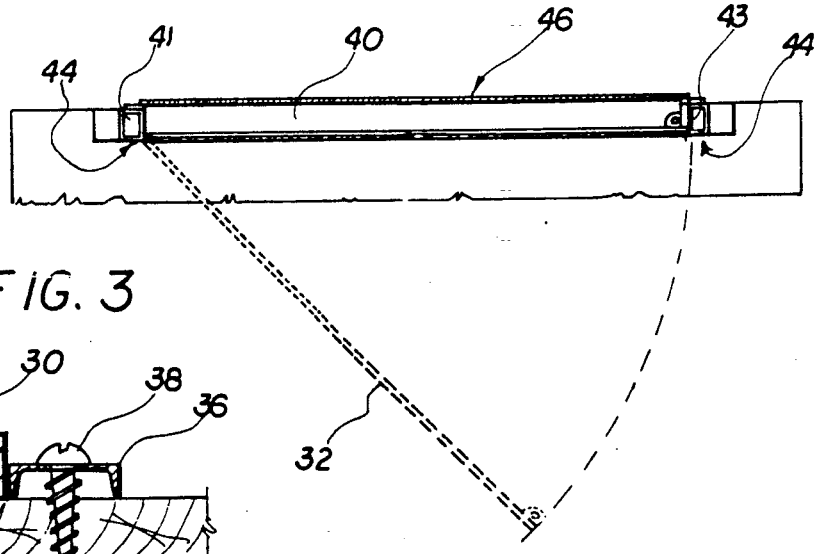
FIG. 2 is a horizontal sectional view of the mirror and concealed jewelry case showing in phantom a mirror open to reveal the concealed jewelry case.
Figure 3:
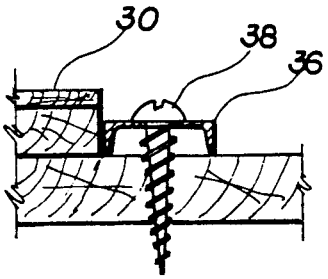
FIG. 3 shows the mounting of the dresser mirror through lines 3—3 on FIG. 4.

As best seen in FIGS. 2–4 resting on the top surface 22 of the dresser 20, abutting the back edge of the dresser 20, is a mirror/jewelry case assembly 30, comprised of a mirror or closure panel 32 hingeably connected thereto. As shown in FIG. 5, the mirror assembly 30 is securely attached to the dresser 20 by means of a flat bar 36 secured by screws 38 through the bar 36 and into the back of the mirror assembly 30 and the dresser 20. Other conventional means may be utilized to connect assembly 30 to dresser 20.

FIG. 2 is a horizontal sectional view of the mirror/-jewelry case assembly 30. From this view the shallow depth of the mirror/jewelry case assembly 30 is apparent. It is important that the depth of the mirror assembly 30 be shallow so as not to attract attention to the depth of the mirror assembly 30 and arouse suspicions as to what may lie behind the mirror 32. By maintaining a shallow depth, the mirror/jewelry case assembly 30 presents as a common, sturdy dresser mirror and its stealth function is accomplished.

FIGS. 1, 2 and 6 show that the assembly 30 has an inner compartment 40 with the mirror 32 providing a front panel or cover for said compartment 40. Assembly 30 also has a back 46, a top panel 48, a bottom panel 49, a left vertical side panel 41, and a right vertical side panel 43. As shown in phantom, mirror 32 pivots around a hinge 44 so that the mirror 32 swings open to reveal the inside of the compartment 40. The mirror 32 may be comprised of a mirror panel and a reinforcing planar panel integrally connected thereto, or may be a mirrored glass panel alone.

It is a key feature of the invention that the hinge 44 is located in a concealed position, for example behind the exposed front surface of the mirror 32 or behind panel 41 so that it is not visible from the front of the assembly 30. Further, no outwardly visible signs of the movable nature of the mirror 32 should be presented such as knobs or latching devices so that the mirror 32 appears to be rigidly secured to the assembly 30 belying the true nature of the assembly 30 as a jewelry cabinet.

FIG. 6 is a front view of compartment 40 with mirror 32 removed to show the interior of the compartment 40. FIG. 7 is a partial side view the compartment 40 along the line 7—7 in FIG. 6. From these two figures can be seen, first, near the top thereof, a necklace rack 60 being a horizontal protrusion 62 extending forwardly from the back panel 46, with hook means 64 for hanging necklaces 66 also extending forwardly therefrom.

Spaced from the necklace rack 60 so as to allow necklaces to freely hang therefrom is a ring rack 70. The ring rack 70 is made of a horizontal protrusion 72 extending forwardly from the back panel 46 and having at least one narrow trough 74 extending the length thereof from side to side. The width of the trough 74 is such as to allow the band of conventional rings to be inserted therein and securely held.

Spaced below the ring rack 70 may be another ring rack 80, identical in form and function to ring rack 70. In FIG. 7, a ring 86 is shown in position in the trough 84 in the ring rack 80.

Spaced a short distance below the ring rack 80 may be a shelf 90 being merely a horizontal protrusion 92 adapted to have small items of jewelry and the like set upon it.

Spaced a short distance below the shelf 90 may be an additional shelf 100, identical in form and function to shelf 90.

The surfaces of the necklace rack 60, ring racks 70 and 80 and shelves 90 and 100 as well as the rest of the interior surface of compartment 40 are preferably covered by a thin covering of velvet, felt, or the like, generally designated as 110, to protect the jewelry from scuffing and to beautify the interior of the compartment 40.

In the preferred embodiment, as best seen in FIGS. 2 and 5, a means for locking the closure panel or mirror 32 in its closed or concealing position with respect to assembly 30 may be provided in the form of a spring biased pin 39 having a looped, finger engageable end 42 disposed within a recess 49 in top panel 48 of assembly 30. Pin 39 is disposed through aligned apertures defined by guide members 45 and 47, respectively, connected to back panel 46. Biasing means such as spring 50 is disposed therebetween so that the upward movement of pin 39 by pulling on looped end 42 will compress spring 50, thereby urging pin 39 back to the at rest position shown in FIG. 5. Pin 39 is reciprocally moveable within said apertures. The lower or terminal end of pin 39 is disposed through an aperture in guide member 52 in the at rest position shown in FIG. 5, thereby retaining panel 32 in its closed position. Guide member 52, as best shown in FIG. 2, is integrally connected to mirrored panel 32 and defines an aperture therethrough which aligns with the apertures defined by guide members 45 and 47 when the mirrored closure panel 32 is in the closed position shown in FIG. 1. By recessing the looped end 42 of pin 39 within recess 49, said locking means is not readily visible to an observer and therefore is essentially hidden. To open or close the jewelry case 40 within assembly 30, one merely lifts up on the looped end 42 of pin 39, causing the lower end of pin 39 to move out of the aperture in member 52. One can then move panel 32 into the open position.

It should be pointed out that, in the preferred embodiment, but not by way of limitation, the closure panel 32 is connected to assembly 30 with self-closing type hinges wherein when said closure 32 is moved to its open position, biasing means associated with said hinges urges said closure toward the closed position shown in FIG. 1.

Although the preferred embodiment of the invention has been disclosed by the inventor to include one necklace rack 60, two ring racks 70, 80, and two shelfs 90, 100, the invention is not intended to be limited to this configuration. The configuration is shown merely as an example of the invention. It is recognized that departures may be made therefrom within the scope of the invention and that obvious modifications will occur to a person skilled in the art.

I claim:

1. A concealed jewelry case and dresser combination, comprising:

(a) a conventional dresser having a flat horizontal top and a rear edge; and (b) a mirror/concealed jewelry case assembly, resting upon and abutting the rear edge of said to of said dresser, said mirror assembly being shallow in depth relative to the depth of said dresser whereby said mirror/concealed jewelry case assembly appears to be merely a sturdy mirror support and not a concealed jewelry case, said mirror/concealed jewelry case assembly defining an inner concealed jewelry storage compartment, said mirror assembly having a mirrored front-facing closure panel hingedly connected thereto, hinge means to allow swinging said closure panel between an open and closed position, said hinge means being concealed from visual inspection when said closure panel is in the closed position so as not to be visible from the front of said concealed jewelry case;

a concealed locking means connected to said mirror/-jewelry case assembly for releasably connecting said closure panel in closing relationship over said jewelry storage compartment;

a necklace rack disposed within said inner concealed jewelry storage compartment comprising a forwardly directed horizontal protrusion from the back of said inner compartment and further comprising a plurality of hooks extending forwardly from said horizontal protrusion, said hooks disposed to receive necklaces for hanging;

an aperture defined by said top panel member communicating the storage compartment with the exterior thereof;

at least one annular storage compartment locking pin guide member located in said storage compartment and having a central axis, colineal with said aperture;

a locking pin, removably disposable through said aperture and said storage compartment guide member, positionable between a first locking, position and a second, unlocked position;

biasing means for retaining at least a portion of said pin in registry simultaneously with both said aperture in said top panel member and said guide member, thereby rendering said locking pin in said locked position;

an annular closure panel locking pin guide member attached to the rear face of said closure panel having a central axis colineal with said storage compartment guide member and said aperture in said top panel of said jewelry case when said closure panel is in the closed position, whereby said closure panel may be locked in said closed position by said locking pin extending through said annular closure panel guide member and said storage compartment guide member and whereby said closure panel may be opened by manually lifting said pin against said biasing means until said pin is no longer disposed through said annular closure panel guide member thereby allowing said closure panel to be moved into the open position.

2. A concealed jewelry case and dresser combination, comprising:

(a) a conventional dresser having a flat horizontal top and a rear edge; and (b) a concealed jewelry case assembly having an interior defined by a pair of shallow generally vertical sidewalls, a shallow generally horizontal top panel member connected therebetween, a shallow generally horizontal bottom and a planar generally vertical rear wall, said concealed jewelry case defining an open front;

a planar front closure panel hingedly connected to said jewelry case adapted to swing between a first, closed, position in which said front panel covers said open front, and a second, open, position in which said open front is uncovered and access can thereby be gained to the interior of said case, said front panel having a mirrored front face and a rear face;

said jewelry case assembly resting upon and abutting the rear edge of said top of said dresser and being substantially shallow in depth relative to the depth of said dresser whereby said mirror/concealed jewelry case assembly appears to be merely a sturdy mirror support and not a concealed jewelry case, said jewelry case assembly defining an inner concealed jewelry storage compartment;

hinge means connected between said jewelry case and said closure panel to allow swinging said closure panel between said open and said closed positions, said hinge means being concealed from visual inspection when said closure panel is in the closed position so as not to be visible from the front of said concealed jewelry case;

comprising means for releasably locking said closure panel in the closed position;

said means for locking said closure panel in said closed position comprises:

an aperture defined by said top panel member communicating the storage compartment with the exterior thereof;

at least one annular storage compartment locking pin guide member located in said storage compartment and having a central axis, colineal with said aperture;

a locking pin, removably disposable through said aperture and said storage compartment guide member, positionable between a first, locking, position and a second, unlocked position;

biasing means for retaining at least a portion of said pin in registry simultaneously with both said aperture in said top panel member and said guide member, thereby rendering said locking pin in said locked position;

an annular closure panel locking pin guide member attached to the rear face of said closure panel having a central axis colineal with said storage compartment guide member and said aperture in said top panel of said jewelry case when said closure panel is in the closed position, whereby said closure panel may be locked in said closed position by said locking pin extending through said annular closure panel guide member and said storage compartment guide member and whereby said closure panel may be opened by manually lifting said pin against said biasing means until said pin is no longer disposed through said annular closure panel guide member thereby allowing said closure panel to be moved into the open position.

* * * * *